United States Patent [19]

Silvestri

[11] Patent Number: 4,536,124

[45] Date of Patent: Aug. 20, 1985

[54] REVOLVING-LADLE TURRET FOR CONTINUOUS CASTING STEEL PLANTS

[75] Inventor: Oreste Silvestri, Segrate, Italy

[73] Assignee: Innse Innocenti Santeustacchio S.p.A., Brescia, Italy

[21] Appl. No.: 425,653

[22] Filed: Sep. 28, 1982

[30] Foreign Application Priority Data

Oct. 2, 1981 [IT] Italy ..... 24274 A/81

[51] Int. Cl.[3] ..... B66C 1/44

[52] U.S. Cl. ..... 414/744 R; 414/590; 414/917

[58] Field of Search ..... 414/744 R, 590, 917, 414/719

[56] References Cited

U.S. PATENT DOCUMENTS 3,942,650 3/1976 Peytavin ..... 414/744 R

FOREIGN PATENT DOCUMENTS 607767 5/1978 U.S.S.R. ..... 414/744 R

*Primary Examiner*—Terrance L. Siemens

*Attorney, Agent, or Firm*—Fleit, Jacobson, Cohn & Price

[57] ABSTRACT

A revolving-ladle turret having a turret member furnished with a pair of ladle-carrying arms, mounted on a platform which rotates about a vertical axis. The turret member is supported by a pair of articulated linkages similar to parallelograms of the double-handle type. The upper or bridge sides of the parallelograms are horizontal and rigidly supported by the platform and extend parallel to the ladle-carrying arms. These parallelograms have their respective handles shaped at right angles and are linked to the turret member in positions which are symmetrical to it about the axis of rotation of the platform. The articulated parallelograms fundamentally constitute synchronizing devices for the displacements of all of the points of the turret member and of the attached ladle-carrying arms.

1 Claim, 2 Drawing Figures

REVOLVING-LADLE TURRET FOR CONTINUOUS CASTING STEEL PLANTS

BACKGROUND OF THE INVENTION

1. Field of the Invention

The present invention relates to the field of revolving-ladle turrets for continuous casting steel plants. More particularly, the invention relates to ladles of the type which include, on a base structure, a platform which rotates about a vertical axis, a turret member mounted on the platform, a pair of ladle-carrying arms extending out from diametrically opposed points on the turret member, and motor elements for rotation of the platform and for vertical displacement of the turret member.

2. Description of the Prior Art

Use of ladle-carrying turrets has made it possible to halve or, at least, reduce in a substantial way, the down time between two successive feeds of molten steel into the distributor of a continuous casting steel plant. In fact, while the first ladle, held by the corresponding arm in the casting position, discharges steel into the distributor, a second ladle full of molten steel can be loaded on the other arm. When the first ladle has been completely emptied, the turret with the empty ladle and the full ladle is raised, rotated 180 degrees, and then lowered to the initial height in order to recommence the simultaneous operations of discharging molten steel from the full ladle positioned over the distributor and the replacement of the empty ladle with another ladle already loaded with molten steel.

During all of these operations, the ladle-carrying arms must be held in horizontal positions.

Satisfaction of this necessity is very difficult to achieve due to the constant and evident situation in which there are unbalanced loads which act on the revolving-ladle turret.

In fact, the ladles carried at the ends of the turret arms have large, different, and quite variable weights, depending on the operating phase of the turret at any one time. This means that the straight-line action of the resultant of the weights acting on the turret not only does not coincide ever with the center-of-gravity vertical axis or the axis of rotation of the turret itself, but its distance from this axis (eccentricity) varies within a rather broad range of values, the limits of which, being both identical and contrary, are established when a full ladle is vertically above the distributor and when an empty ladle is above the distributor.

Also, for the support and vertical displacements of the turret, two identical hydraulic cylinders are generally used, symmetrically spaced about the axis of rotation of the turret. The straight-line action of the resultant of the thrusts of these cylinders coincides with the axis of rotation.

Consequently, an unbalancing torque constantly acts on the turret, determined by the resultant of the loads and by the resultant of the thrusts of the cylinders. This unbalancing torque must be effectively resisted or, better, eliminated.

For this purpose, changes have been made affecting the hydraulic cylinders for raising and support of the turret, so that the straight-line action of the resultant of their thrusts could be from time to time displaced so as to coincide at all times with the straight-line action of the resultant of the loads. Thus, devices and appliances have been devised and applied for example, to regulate appropriately the pressures of operating fluids in the cylinders, or balancing devices and/or compensating devices which, in addition to an acknowledged low reliability, have presented the inconvenience of becoming very complicated from both the structural and the functional points of view.

SUMMARY OF THE INVENTION

The problem which is at the base of this invention is that of providing a revolving-ladle turret which includes a simple structure and a reliable functional device capable of effectively resisting the unbalancing torque discussed above.

This problem is solved by the provision of a revolving-ladle turret that has a turret member displaceable in a horizontal direction with respect to a platform that supports the turret member. At least one articulated linkage similar to a parallelogram of the double-hand type, which has a horizontal bridge side carried by said platform and extending parallel to the ladle-carrying arms, is positioned between the platform and turret member. The handles of said articulated parallelogram are furnished with protruding parts essentially at right angles, identical and equally spaced, the free ends of which are pinned to the turret member in positions which are symmetrical about the axis of rotation of the platform.

Advantageously, the turret member is supported by the platform by means of two of the double-handle articulated linkages or parallelograms, the bridge sides of which are horizontal and parallel to the ladle-carrying arms, and reciprocally spaced by a pre-established length and braced by means of cross members.

BRIEF DESCRIPTION OF THE DRAWINGS

More characteristics and advantages of the invention will become apparent from the description of a representative embodiment of a revolving-ladle turret according to this invention, made with reference to the attached drawings which are provided as an example but are not intended to be limiting.

DESCRIPTION OF A PREFERRED EMBODIMENT

Figure 1:
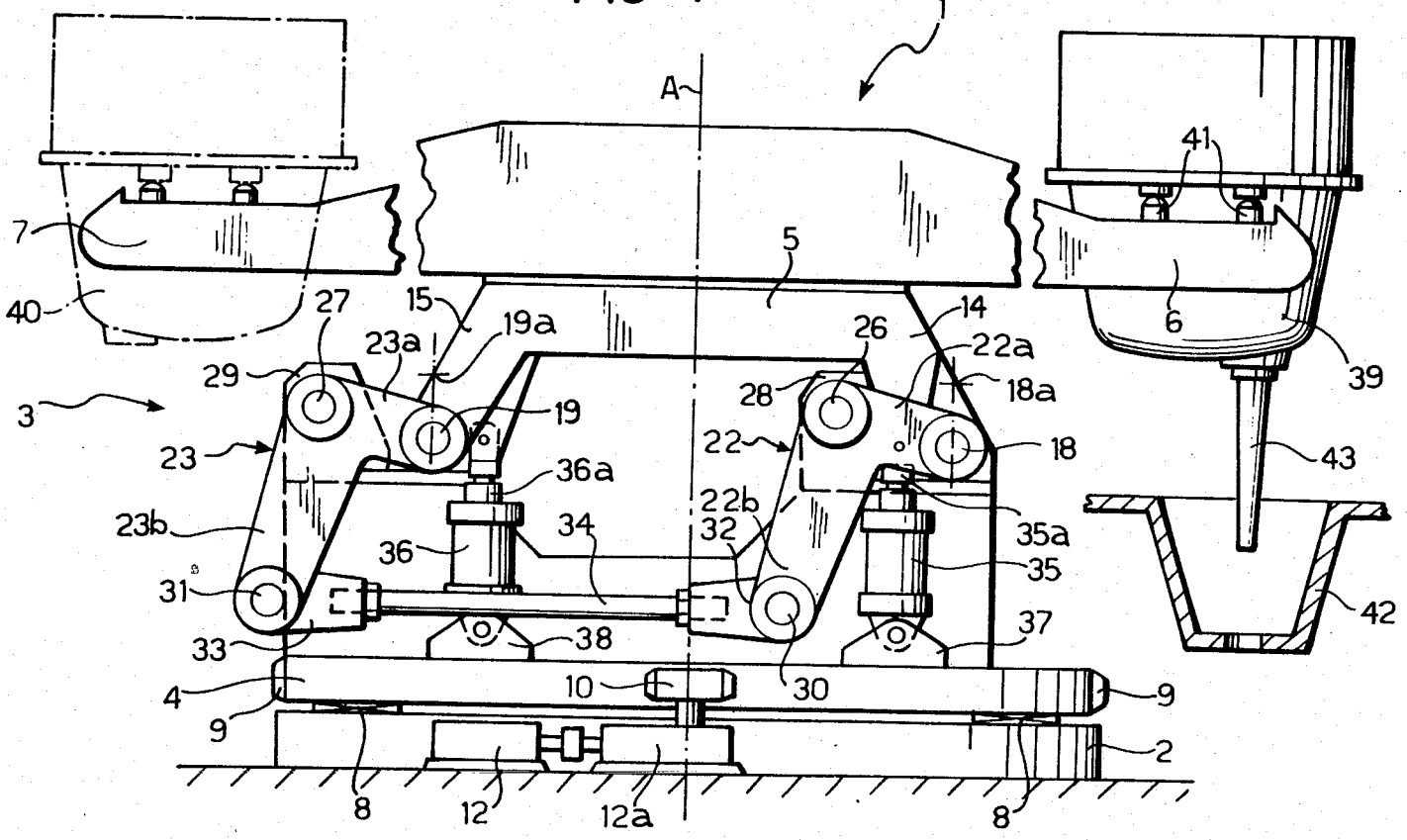
FIG. 1 schematically shows a raised view of a revolving-ladle turret according to the invention.
Figure 2:
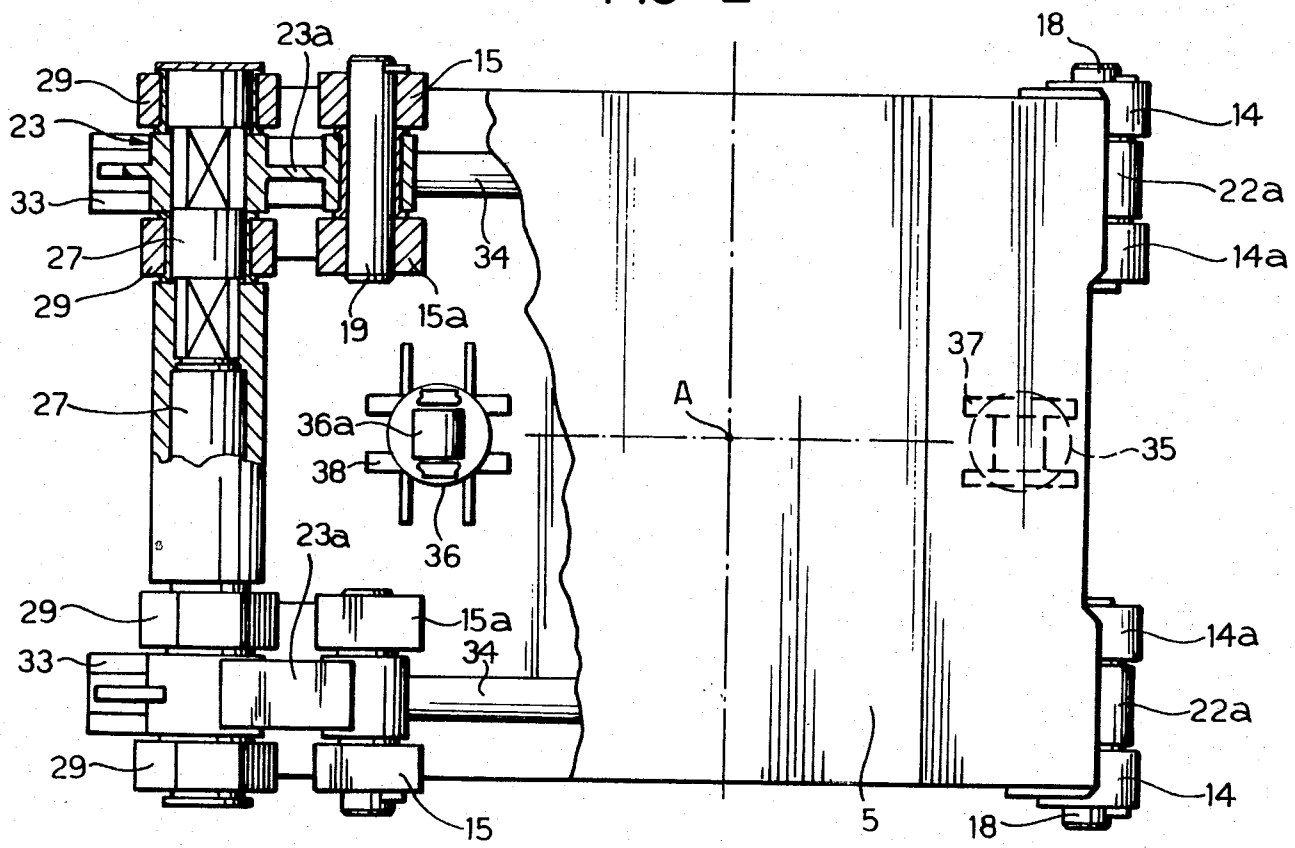
FIG. 2 is a plan view, partially in section, of a detail of the revolving-ladle turret of FIG. 1.

With reference to the drawings, one embodiment of a revolving-ladle turret, generally designated 1, is illustrated. The turret 1 has a fixed carrying structure, of which only the base 2 is schematically represented, and a moveable structure. This moveable structure includes a revolving platform 4 and a turret member 5 which conventionally supports a pair of ladle-carrying arms 6, 7 which are identical and extend out from diametrically opposed points on the turret member 5.

The platform 4 is supported by the base 2 for rotation about a vertical axis A by technical means which are altogether conventional, for example, by means of a number of hydrostatic sliding blocks 8.

A crown gear 9 may be circumferentially fastened to or formed as part of the platform 4 to move the moveable structure. The gear 9 is engaged with one or more motorized pinions 10. Each one of the pinions is rotated by a respective motor 12 through a gear box which may be advantageously located inside the base structure 2.

In the preferred, but not limiting, realization of the invention, the turret member 5 has a four-sided base and is furnished on its lower extremities in correspondence with each of its corners, with respective pairs of plate-shaped ears 14–14*a*, and 15–15*a*, which are identical, parallel and extend downward. Corresponding to its lower end, each pair of plate-shaped ears supports a respective horizontal pin 18 or 19. The axes of the pins 18 and the pins 19 are coplanar and are symmetrically spaced about the vertical axis A of rotation of the platform 4, which is also the center-of-gravity vertical axis of the turret member 5.

Pins 18 and 19 are linked in the above-mentioned fashion, to two articulated linkages 3 similar to parallelograms of the double-handle type, by means of which the turret member 5 is supported by the revolving platform 4.

Since the articulated parallelograms are structurally and functionally identical, only one of them is described below.

Each articulated parallelogram includes a pair of bell cranks 22, 23, which are identical and equally spaced, and which have their fulcrums on respective pins 26, 27 held in place by supports 28, 29. Such supports are rigidly fixed on the platform 4 with which they rotate. The arms 22*a*, 23*a* of the bell cranks have their respective ends pinned to the horizontal pins 18 and 19 of the turret member 5. Arms 22*b* and 23*b* of the bell cranks 22 and 23 have their free ends engaged to rotate on horizontal pins 30, 31, carried on the fork ends 32, 33 of a rigid horizontal rod 34.

The rod 34 constitutes the connecting rod of the articulated parallelogram 3 discussed above. The plane or bridge side of the parallelogram containing the pins 26, 27 is horizontal and extends parallel to a plane passing through like points on the ladle-carrying arms 6, 7. The pins 26, 27 connect the articulated linkage with the platform 4. The arms 22*b* and 23*b* of the bell cranks 22 and 23 constitute the connecting rods of the articulated parallelogram 3.

Advantageously, and in accordance with a preferred, but non-limiting, realization of the invention, the two articulated parallelograms by means of which the turret member 5 is supported by the revolving platform 4 are reciprocally spaced by a pre-established length and are reciprocally braced corresponding to pins 26, 27. In other words, pins 26 and 27 are common to both of the articulated parallelograms and constitute cross braces calculated to cooperate efficiently for support of the turret member 5.

Numbers 35 and 36 schematically represent two hydraulic cylinders which are hinged below to supports 37, 38 carried by the revolving platform 4 and having respective stems 35*a*, 36*a* hinged above to the turret member 5. Preferably, the hinged points of the stems 35*a* and 36*a* are horizontally aligned in a middle direction with respect to the pins or bridge sides 26–27 of the above-described articulated parallelograms. These hydraulic cylinders 35, 36 are used, in accordance with technical custom, for the lifting and holding of the turret member 5 whenever required. Not likewise conventional, the cylinders 35 and 36 are mounted at the edge of the revolving platform 4 and, thus, rotate with the turret member 5.

Numbers 39 and 40, respectively, indicate ladles of the conventional type, intended to be hung from or supported by the free ends of the ladle-carrying arms 6, 7 through conventional means shown as number 41.

The functioning of the revolving-ladle turret of this invention is as follows.

In an initial state (FIG. 1), the turret is in a "lowered" position. Ladle 39 is held vertically above a distributor 42 of a continuous casting plant, toward and into which extends a discharging conduit 43. The ladle 39 is initially full and is emptied by unloading of the molten steel into the distributor 42. Ladle 40, which is held in the loading position, is full of the pre-established quantity of molten steel by the time ladle 39 is empty.

From this initial state, in which the loads acting on the turret are evidently out of balance, the turret member 5 is lifted to a pre-established height so that the conduit 43 is safely out of the distributor 42. Subsequently, the turret member is rotated 180 degrees about the axis A in order to convey the full ladle 40 into the position for discharging into the distributor 42 and to convey the empty ladle 39 into the replacement loading position. Finally, the turret member 5 is lowered back to position the conduit 43 of the full ladle 40 in the distributor 42, while the empty ladle 39 is replaced by another ladle which has been previously loaded with molten steel.

At the time of lifting, as well as during rotation of the turret member 5, the straight-line action of the resultant of the weights of the ladles is clearly displaced from the vertical axis A toward the full ladle 40, while the straight-line action of the resultant of the thrusts of the hydraulic cylinders coincides with axis A. The consequent unbalancing torque, in a counter-clockwise direction, favors cylinder 35 in its work of lifting and holding up the turret member 5 and related ladles, while it hinders hydraulic cylinder 36.

The movements of the turret in these circumstances would signify a loss of the required horizontal relationship of the ladle-carrying arms 6 and 7, in the absence of the present invention, since the point at which the cylinder 35 is applied to the turret member 5 would undergo increased lifting compared to that of the cylinder 36.

The desired horizontal relationship of the ladle-carrying arms 6 and 7 is guaranteed by the presence of the two articulated parallelograms 3 provided by the present invention. In fact, their presence and their arrangement oblige every point on turret 5 to effect synchronous displacements. Specifically, and still with reference to FIG. 1, any stress which would tend to effect an angular counter-clockwise movement of either of the bell cranks 22 would confer an identical angular counterclockwise movement to the cranks 23 with a substantial "lightening" of the load weighing on the hydraulic cylinder 36. In practice, it is as if the above-mentioned articulated parallelograms establish an efficient mutual assistance between the hydraulic cylinders intended for lifting and holding up the turret member 5 and attached ladles.

At the end of the lifting phase of the turret member 5, the new positioning of pins 18 and 19 is shown by points 18*a*, 19*a* of FIG. 1. It should be noted that in order to achieve this position the turret member has undergone a displacement which has both vertical and horizontal components. To permit the horizontal movement, it has become necessary to eliminate, resisting a strong technical prejudice, the traditional movement of the turret member on vertical guides carried by a base structure.

The articulated parallelograms comprised of rigid elements confer upon the ladle-carrying arms 6 and 7 the required horizontal relationship and offer a surprising, notable and acknowledged functional reliability, besides being simple to construct and equally simple to maintain.

The invention, thus conceived, is susceptible to varying realizations. For example, the hydraulic cylinders 35 and 36, instead of acting on the turret body 5 as previously described, may act directly on the articulated parallelograms, for example, preferably on their horizontal connecting rods.

Other variations are available to the expert in this field, and therefore they fall within the scope of protection as defined in the following claims.

What is claimed is:

1. Revolving-ladle turret comprising:

a turret member having diametrically opposed arms for carrying ladles;

a platform for supporting said turret member;

a pair of linkage means for interconnecting said turret member and said platform, each of said linkage means comprising a pair of bell cranks and a horizontally-extending rod interconnecting lower ends of the bell cranks, each bell crank having an upper end connected to said turret member and a portion intermediate the ends connected to said platform so that said bell crank is pivotable about the connection to said platform;

means for vertically moving said turret member with respect to said platform;

a base for supporting said platform for rotation about a vertical axis; and means for rotating said platform about the vertical axis.

* * * * *